United States Patent [19]

Barsuhn

[11] Patent Number: 4,688,689

[45] Date of Patent: Aug. 25, 1987

[54] TELESCOPING CRANE BOOM

[75] Inventor: Peter Barsuhn, Wilhelmshaven, Fed. Rep. of Germany

[73] Assignee: Fried. Krupp Gesellschaft mit beschrankter Haftung, Essen, Fed. Rep. of Germany

[21] Appl. No.: 841,557

[22] Filed: Mar. 20, 1986

[30] Foreign Application Priority Data

Mar. 23, 1985 [DE] Fed. Rep. of Germany ..... 3510710

[51] Int. Cl.[4] ..... B66C 23/04

[52] U.S. Cl. ..... 212/267; 52/121

[58] Field of Search ..... 212/230, 264, 267, 268; 52/115, 118, 632

[56] References Cited

U.S. PATENT DOCUMENTS

| | | | |
|---|---|---|---|
| 4,327,533 | 5/1982 | Sterner | 212/268 |
| 4,483,109 | 11/1984 | MacDonald et al. | 212/267 |
| 4,490,951 | 1/1985 | Mentzer et al. | 212/268 |
| 4,592,474 | 6/1986 | Rathe | 212/267 |

*Primary Examiner*—Joseph F. Peters, Jr.
*Assistant Examiner*—Stephen P. Avila
*Attorney, Agent, or Firm*—Karl F. Ross; Herbert Dubno

[57] ABSTRACT

So that the boom does not have to be oriented horizontally to change the crane configuration, a remotely controlled double locking device is mounted at the front end of each intermediate telescoping member slidably mounted between the boom base and the inner telescoping member. Each intermediate telescoping member can thus be locked according to choice with the inner telescoping member or another intermediate telescoping member, or with both that telescoping member and a top piece of an extendable rod of an extending device which increases the boom length. This double locking mechanism comprises two double piston mechanisms positioned opposite each other each with an exterior lock bolt operable by an exterior spring-loaded or hydraulic adjusting cylinder and mounted inside this exterior lock bolt an interior lock bolt operable by an interior spring-loaded or hydraulic adjusting cylinder.

8 Claims, 10 Drawing Figures

FIG. 1a
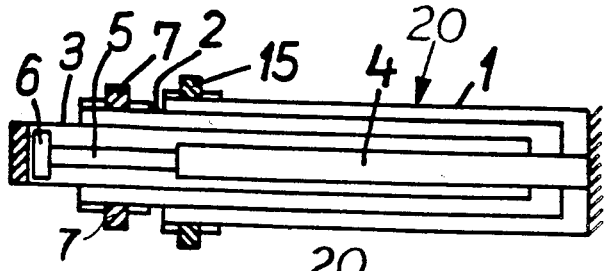
FIG. 1b
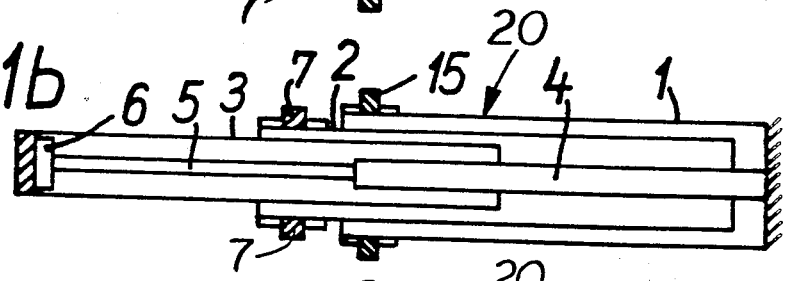
FIG. 1c
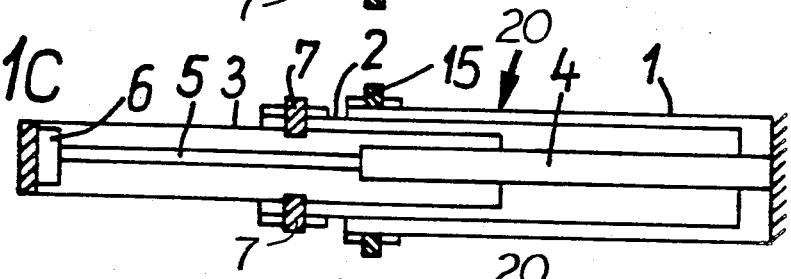
FIG. 1d
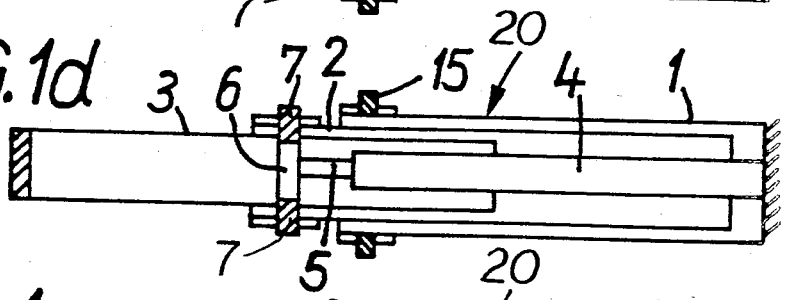
FIG. 1e
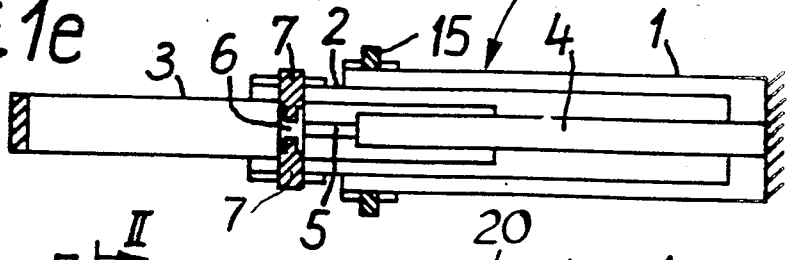
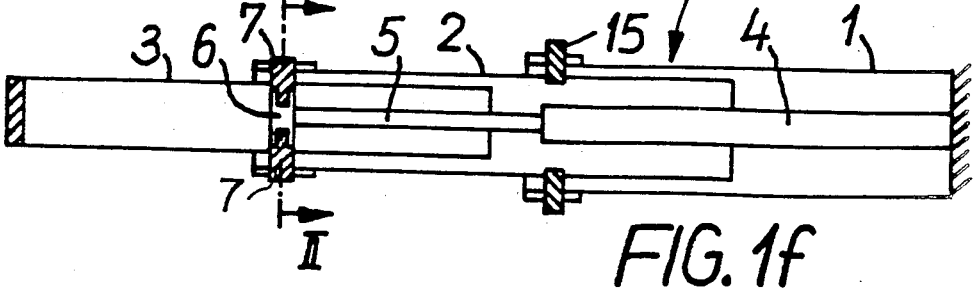
FIG. 1f

TELESCOPING CRANE BOOM

FIELD OF THE INVENTION

My present invention relates to a telescoping crane boom and, more particularly, to a telescoping crane with one or more sections and a mechanism for locking at least one of these sections relative to another in an extended relative position of these two sections.

BACKGROUND OF THE INVENTION

A telescoping crane can comprise a raisable and lowerable boom formed with a plurality of boom members or sections including an inner telescoping member and at least one other boom member lockable in a plurality of final configurations, and a device for extending the boom members.

The locking of the boom members in their relative extended positions normally is effected manually, e.g. by a lock bolt mounted in a mechanical rod, so that when the crane configuration and the boom length are to be changed, the boom must always be lowered into a horizontal position. Moreover, if a luffing peak or auxiliary arm at the top of the boom is being used it must be demounted. These operations are inconvenient and require considerable expenditure of time and effort.

OBJECTS OF THE INVENTION

It is an object of my invention to provide an improved telescoping crane boom.

It is also an object of my invention to provide an improved telescoping crane which considerably reduces operating time and effort.

It is yet another object of my invention to provide an improved telescoping crane having a better readiness for duty than the known cranes and which, in general, obviates drawbacks of the prior art.

SUMMARY OF THE INVENTION

These objects and others which will become more readily apparent hereinafter are attained in accordance with my invention in a telescoping crane having a raisable and lowerable boom comprising a plurality of boom members lockable in a plurality of extended configurations and an extending device for an interior telescoping member.

According to our invention a remotely controlled locking device is mounted at the front end of, at least one, but preferably each of the boom members except the inner telescoping member. The boom members are lockable according to choice in a variety of configurations by the remotely controlled locking devices. A change between configurations can thus take place without lowering the boom.

Furthermore, according to my invention, a remotely operable double locking device is positioned or mounted at the front end of at least one intermediate telescoping member slidably mounted in a boom base and in which the inner telescoping member is slidably mounted.

This locking device can selectively lock the intermediate telescoping member with the inner and/or the nearest other intermediate telescoping member or with that particular telescoping member and the top piece of an extendable piston rod of the extending device.

With this remote double locking device the changing of the crane from a configuration with the shortest allowed boom length into one or several other boom configurations can occur with the boom upright. First the inner telescoping member only is extended by the extendable piston rod of the extending device and locks in this extended position. Then the extendable piston rod is retracted and locks in this position with the closest intermediate telescoping member and subsequently both inner and intermediate telescoping members extend jointly by action of the extendable piston rod. They then lock in that extended position. Since these changes can be conducted in every boom position on account of the remote control, also a special demounting of a luffing peak mounted on the inner telescoping member is not necessary.

The double locking device is necessary only for the telescoping members lying between the boom base and the inner telescoping member. It usually suffices when a simple single locking device is mounted at the front end of the boom base which permits locking with the adjacent telescoping member and/or with the top piece of the extendable piston rod. Since this locking also is remotely controlled, every change of boom configuration can occur without changing the inclination of the boom.

In a particularly advantageous form of my invention, the double locking device comprises two double piston mechanisms positioned opposite each other having an exterior lock bolt operated by an exterior spring-loaded adjusting cylinder or hydraulic adjusting cylinder and mounted in that exterior lock bolt an interior lock bolt operated by an interior springloaded or hydraulic adjusting cylinder. This arrangement provides a simple space saving structure and allows a propitious course for the locking process as well as a reliable control and supervision of the changes in boom configuration.

It is also advantageous when the intermediate telescoping member between the boom base and the inner telescoping member is lockable by a locking device in an intermediate position between the extended and retracted positions. Thus in the same way as has been described previously, intermediate positions of the boom can be provided.

By definition, the boom members include the boom base the extendable piston rod with top piece, and the telescoping members including both inner and intermediate members.

BRIEF DESCRIPTION OF THE DRAWING

The above and other objects, features and advantages of my invention will become more readily apparent from the following description, reference being made to the accompanying highly diagrammatic drawing, in which:

FIGS. 1*a*–1*f* are schematic cross sectional views showing individual configurations of an extendable boom for a telescoping crane according to my invention during a length changing process;

SPECIFIC DESCRIPTION

Figure 1:
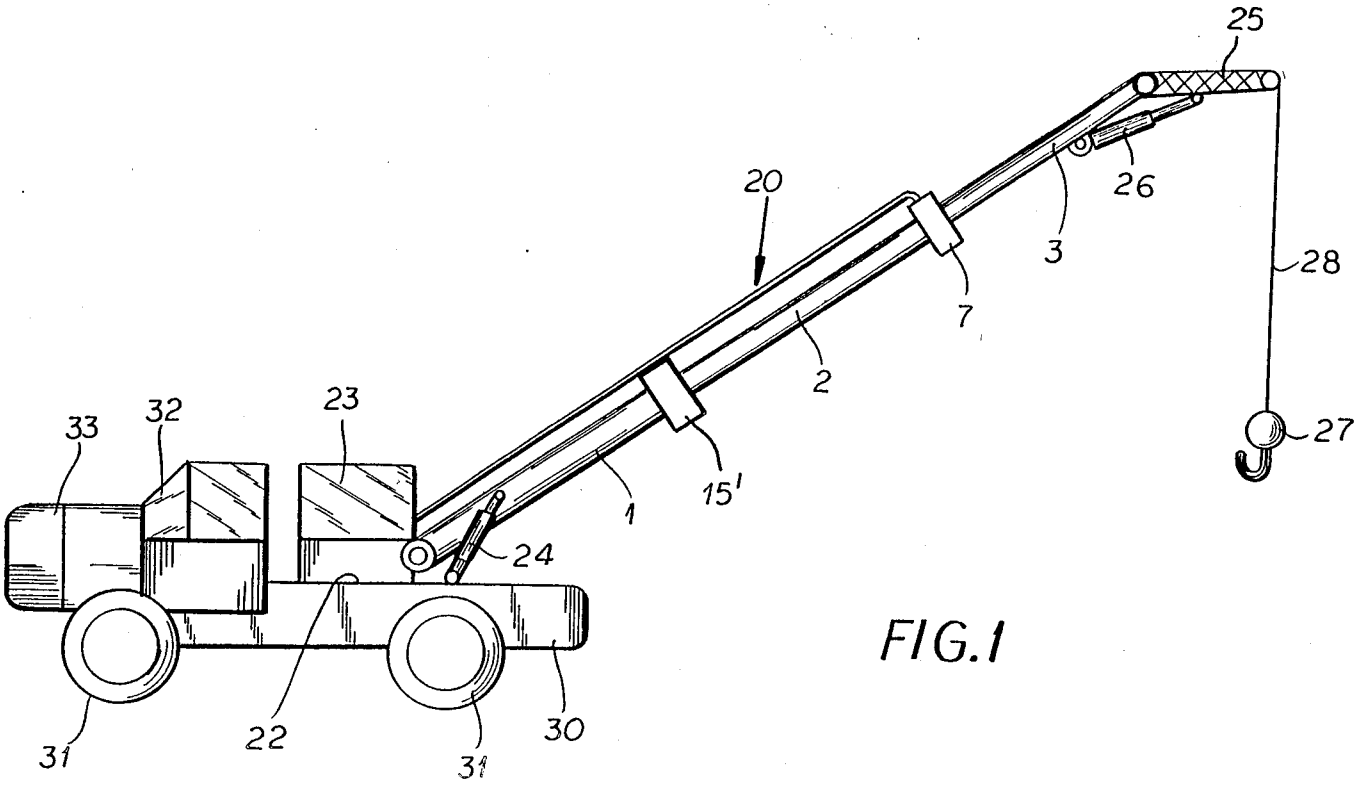
FIG. 1 is a side elevational view of a crane.

As can be seen in FIG. 1, the boom 20, which operates as described in connection with FIGS. 1*a*–1*f* below, comprises the members 1,2 and 3, a pivot 21 mounting the base section of member 1 so that it can pivot on a turntable 22 about a horizontal axis for raising and lowering the boom, and a hydraulic cylinder 24 connected to the boom for raising and lowering same.

A cabin 23 for the crane operator is also provided on the turntable and the end of the boom can carry an arm 25 and its pivoting mechanism 26. The crane hook 27 can be suspended by a wire rope 28 from this arm.

A double sided hydraulic locking device 7 is provided between the intermediate section 2 and the inner section 3 while a similar locking device 15' can be provided between the base section 1 and the section 2. Alternatively, a manual lock can be provided here.

The turntable is mounted on a vehicle chassis 30 having wheels 31, a driver's compartment 32 and an engine compartment 33.

The boom 20 of a first embodiment of a telescoping crane according to my invention best seen in FIGS. 1*a*–1*f* and FIGS. 2 and 3 comprises a boom base 1, an intermediate or central telescoping member 2, an inner telescoping member 3 and the arm 25 (not visible in these FIGS. but seen in FIG. 1).

For the telescoping motion an extending device 4 is within the boom with an extendable piston rod 5 and top piece 6 for it.

On both sides of the front end of the central or intermediate telescoping member 2 a double locking device in the form of two double piston mechanisms 7 is mounted.

Figure 2:
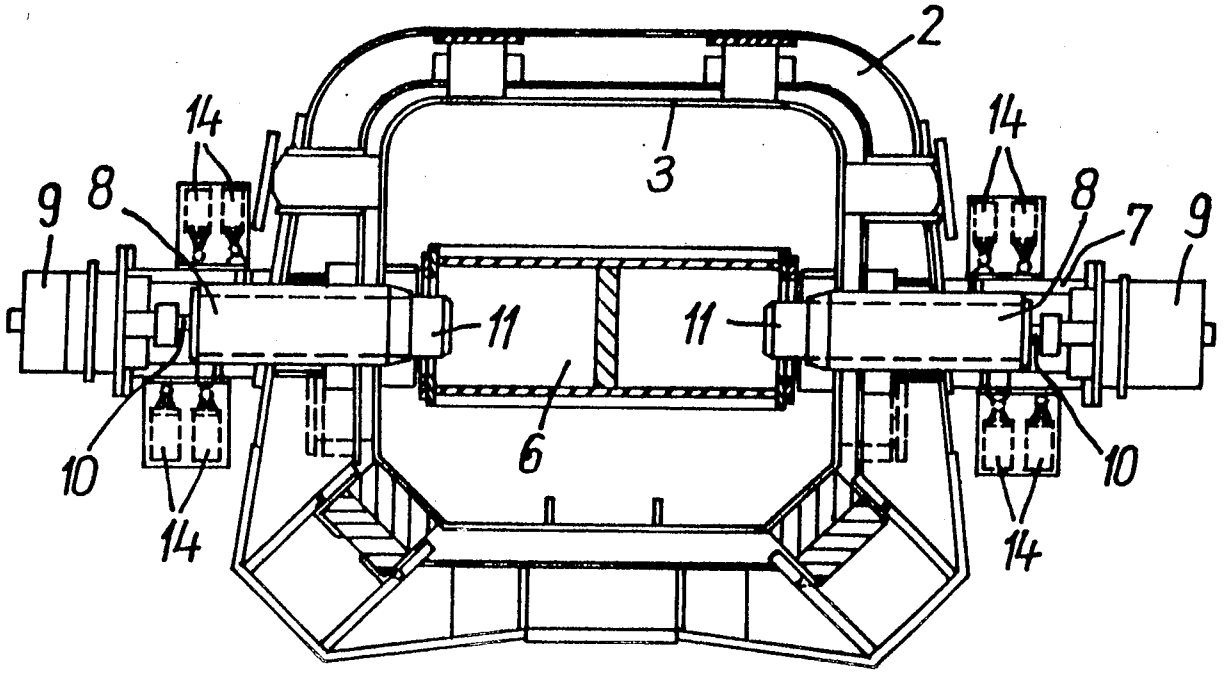
FIG. 2 is a cross sectional view through the double locking device of the telescoping crane of FIG. 1 found in engagement with the top piece of the extendable piston rod and the interior telescoping member taken along the section line II—II in FIG. 1*f*.
Figure 3:
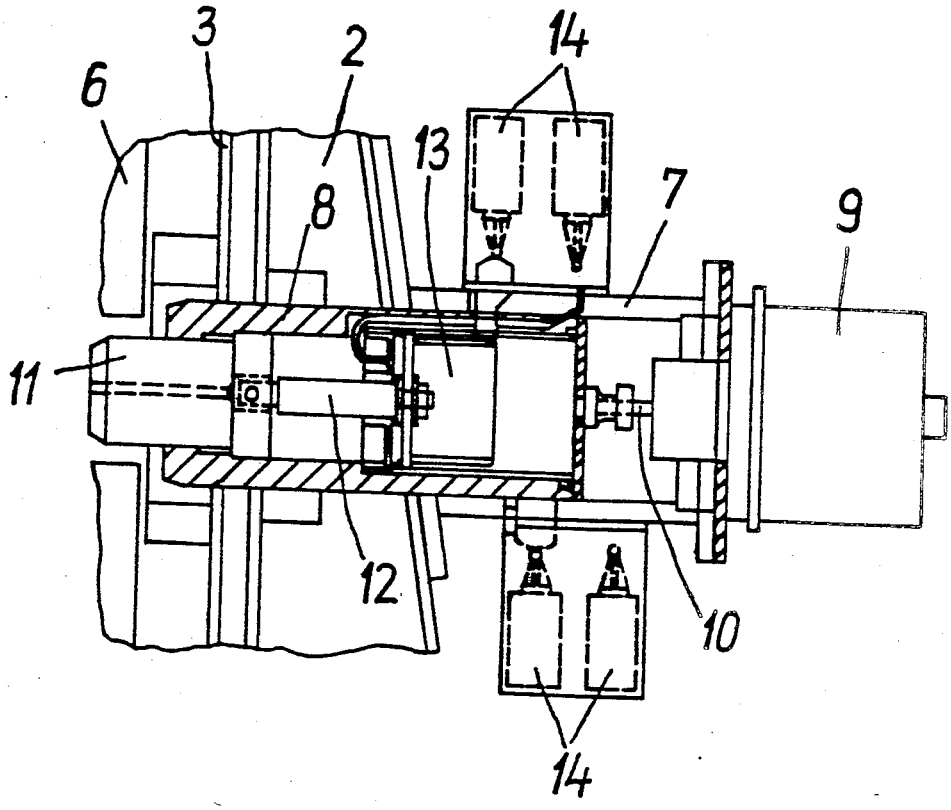
FIG. 3 is a cross sectional view through a part of the right side of the telescoping crane according to FIG. 1 showing the double piston mechanism also visible in FIG. 2.

As shown in FIGS. 2 to 3 the double piston mechanism comprises an exterior lock bolt 8, which is driven by a cylinder rod 10 of a spring-loaded or hydraulic adjusting cylinder 9 located externally of the booms (as can be seen from FIGS. 2 and 3) and an interior lock bolt 11 with a spring-loaded or hydraulic adjusting cylinder 13 and associated cylinder rod 12, which are enclosed in the exterior lock bolt 8.

The exterior lock bolt 8 is inserted in a suitable recess in the inner telescoping member 3 in a position shown and locks it with the intermediate or central telescoping member 2.

In the retracted position the double locking device is unlocked.

In the extended position shown in FIG. 1*f* the interior lock bolt 11 is pushed in a suitable recess in top piece 6 of the extendable piston rod 5 and this simultaneously locks the inner telescoping member 3 and the central or intermediate telescoping member 2. The interior lock bolt 11 may be retracted completely into the exterior lock bolt 8. This frees the top piece 6. The positions of the bolt 8 and 11 are signaled by limit switches 14.

When an extension of the boom 20 from the shortest configuration shown in FIG. 1*a* is to be made, the inner telescoping member 3 is first extended by action of the extendable piston rod 5. Moreover, approximately in the lowered position of the boom 20 the central telescoping member 2 is locked by a simple single locking device 15 with the boom base 1. In the raised boom 20 this locking is not required, since the central telescoping member 2 is held in the boom base 1 by the force of gravity.

With the inner telescoping member 3 extended the central telescoping member 2 is locked with the inner telescoping member 3 by the extended exterior lock bolt 8 (FIG. 1*c*) 2 and 3. After that, the extendable piston rod 5 is retracted until it likewise may lock with the central or intermediate telescoping member 2 by extending the inner lock bolt 11 (FIG. 1*d* and 1*e*) 2 and 3. Subsequently, the inner telescoping member 3 and the central or intermediate telescoping member 2 are jointly extended and the intermediate telescoping member 2 locks in place with the boom base 1 by the single locking device 15. Because of the remote control of the locking devices whose control conduits 35 run to the cabin 23, all operations can be undertaken in an arbitrary position of the boom 20. A shortening of the boom 20 occurs in a suitable way by reversing the above steps.

Figure 4:
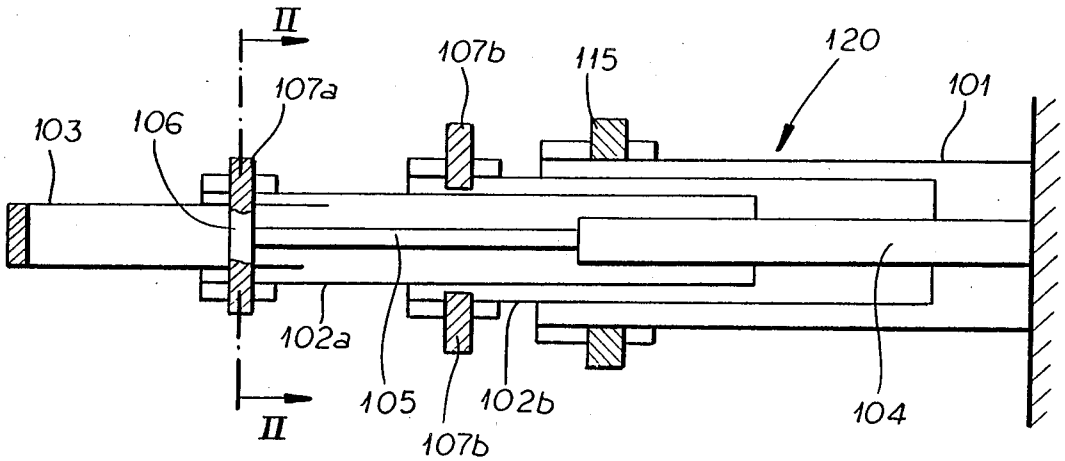
FIG. 4 is a schematic cross sectional view showing another embodiment of an extendable boom for a telescoping crane according to my invention.

A second embodiment of the boom 120 is shown in FIG. 4. In this embodiment, two intermediate or central telescoping members 102*a* and 102*b* provide extra length and flexibility of operation. Similar to the first embodiment above, first intermediate telescoping member 102*b* is mounted slidably in boom base 101 and is lockable with it by a single locking device 115 mounted at the front end of boom base 101. A second intermediate telescoping member 102*a* is mounted slidably in the first intermediate telescoping members 102*b* which has two double piston mechanisms 107*b* mounted at its front end identical to the double piston mechanisms 7 of the previous embodiment which locks it with second intermediate telescoping member 102*a*. Furthermore, an inner telescoping member 103 is slidably mounted in second intermediate telescoping member 102*a*. Second intermediate telescoping member 102*a* also has two double piston mechanisms 107*a* identical to double piston mechanisms 107*b* mounted at its front end. This embodiment has a centrally mounted extending device 104 having an extendable piston rod 105 with a top piece 106 which is engagable by unshown inner lock bolts of both double piston mechanisms 107*a* and 107*b*. If necessary, slots in the telescoping members may be provided to facilitate this.

I claim:

1. A telescoping crane, comprising:

a support;

an elongated boom base having one end pivotally mounted on said support and a free end spaced from said one end;

at least one boom member telescopingly received in said boom base and displaceable between a retracted position in which each said boom member has an end proximal to said free end of said base, and an extended position in which said end of each said boom member is remote from said free end of said boom base;

a terminal member telescopingly received in said boom base and each said boom member and extendable therefrom, said members and said base forming a boom of said crane;

an extending cylinder in said boom base having a piston rod extendable from said cylinder and provided with a piston head engageable with said terminal member for extending said terminal member of said boom;

a respective remotely controlled double locking device at said end of each said boom member selectively locking another of said members thereto and selectively locking each said boom member to said other of said members and to said piston head; and means for pivotally displacing said boom relative to said support at said one end of said boom base to raise and lower the boom on said support.

2. The telescoping crane defined in claim 1 wherein said other member is another said boom member telescopingly received in the first mentioned boom member.

3. The telescoping crane defined in claim 2 wherein said first mentioned boom member is also provided with a said remotely controlled double locking device at said end thereof selectively locking exclusively with said terminal member or with said terminal member and said head.

4. The telescoping crane defined in claim 1 wherein said other member is said terminal member.

5. The telescoping crane defined in claim 1 wherein each said double locking devices comprises two double piston mechanisms positioned opposite each other and each operable by an adjusting cylinder disposed externally of the respective boom member.

6. The telescoping crane defined in claim 1 wherein each said double locking devices comprises two double piston mechanisms positioned opposite each other and each having an exterior lock bolt operable by an exterior adjusting cylinder and mounted inside said exterior lock bolt, an interior lock bolt operable by an interior adjusting cylinder.

7. The telescoping crane defined in claim 6 wherein said interior and exterior adjusting cylinders are hydraulic cylinders.

8. The telescoping crane defined in claim 6 wherein said interior and exterior adjusting cylinders are spring loaded cylinders.

* * * * *